United States Patent [19]

Zehnder et al.

[11] 4,134,804

[45] Jan. 16, 1979

[54] CYANIDE-FREE ZINC PLATING BATH AND PROCESS

[75] Inventors: Joseph A. Zehnder, Orange; Terry K. Stevens, Milford, both of Conn.

[73] Assignee: Enthone, Incorporated, West Haven, Conn.

[21] Appl. No.: 828,840

[22] Filed: Aug. 29, 1977

[51] Int. Cl.[2] ..... C25D 3/22

[52] U.S. Cl. ..... 204/55 R

[58] Field of Search ..... 204/55 R, 55 Y, 43 Z, 204/114

[56] References Cited

U.S. PATENT DOCUMENTS

| | | | |
|---|---|---|---|
| 3,296,105 | 1/1967 | Rushmere | 204/55 Y |
| 3,318,787 | 5/1967 | Rindt et al. | 204/55 Y |
| 3,411,996 | 11/1968 | Rushmere | 204/55 Y X |
| 4,030,987 | 6/1977 | Fujita et al. | 204/55 R |

*Primary Examiner*—G. L. Kaplan

*Attorney, Agent, or Firm*—DeLio and Montgomery

[57] ABSTRACT

An improved non-cyanide, alkali type zinc plating bath and method is provided, wherein a water-soluble polyamine sulfone compound and a quaternary pyridine compound are added to the zinc plating bath, which is thereafter subjected to electro-deposition conditions and wherein the polyamine sulfone is represented by the general formula

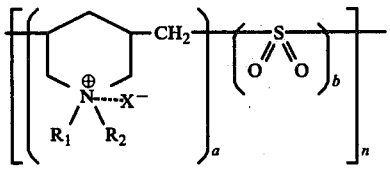

wherein each of $R_1$ and $R_2$ is a member selected from the group consisting of hydrogen, an allyl group, straight-chain and branched-chain alkyl groups each having 1 to 16 carbon atoms, an aralkyl group, and hydroxyalkyl groups of the general formula $HO\text{-}(CH_2)_m$, where m is an integer of 1 to 6;

$X^-$ is a member selected from the group consisting of halogen ion, $HSO_4^-$, $HSO_3^-$, HCOO and $CH_3COO^-$;

"n" is an integer such that the number average molecular weight becomes 2,000 to 350,000; and "a" and "b" are natural numbers having a relation such that a:b = 100:(10 to 100) and wherein the preferred quaternary pyridine compound is N-benzyl-3-methylcarboxylate pyridinium chloride, and the preferred polysulfone compounds are quaternized polyamine sulfones.

22 Claims, No Drawings

CYANIDE-FREE ZINC PLATING BATH AND PROCESS

BACKGROUND OF THE INVENTION

This invention relates to zinc plating or electro-depositing, and more particularly to novel, non-cyanide zinc plating or electro-depositing baths of the alkali-zincate type and to the electro-deposition or plating of bright or semi-bright zinc therefrom. Additionally, this invention is also directed to a process for zinc plating utilizing the novel baths of the present invention.

Conventional zinc electro-depositing or plating baths and processes are generally classified as either a strong alkali type utilizing cyanide compounds as a primary constituent or acid type baths and processes using zinc chloride or zinc sulfate as a primary constituent. Of these, the strong alkali, cyanide type bath and process is most widely utilized in the industry.

While it is generally known that such strong alkali, cyanide-type zinc plating baths and processes can provide a zinc plated surface on a ferrous metal substrate which has sufficient smoothness and a semi-gloss appearance, large amounts of cyanide compounds are utilized in these types of strong alkali zinc plating systems. In such cyanide-type systems it is also conventionally known that small amounts of additional brighteners can be utilized to obtain an even brighter zinc plating. Such conventional brighteners include gelatin, peptone, sodium sulfide, thiourea, polyvinyl alcohol, aldehydes, ketones or salts of organic acids, either added singly or together with the other components of the conventional cyanide-type plating bath.

However, because the cyanide containing strong alkali-type zinc plating baths and processes utilize a large amount of cyanic compounds which themselves are toxic materials, they are becoming less acceptable because of their adverse effect on the environment. It is becoming impossible to discharge the waste solution as such. Accordingly, the cyanide containing alkali-type zinc plating baths and processes have substantial disadvantages, such as the necessity for extensive waste treatment facilities, the requirement for utilization of additional chemical agents for the treatment of the waste solution to remove the residual cyanides, unfavorable operating conditions and the risk of environmental pollution. Thus, from the aspects of operating efficiency, economy, and public safety the use of a zinc plating bath or process utilizing cyanic compounds is rapidly becoming unacceptable.

Furthermore, since zinc electroplating is applied directly onto a ferrous metal substrate in the majority of cases, iron is dissolved in substantial quantities in zinc plating baths containing cyanic compounds. In particular, a ferro ferricyanide complex salt containing cyanide and iron can form with a high degree of stability, so that it cannot easily be decomposed to recover the cyanide. However, in accordance with the present invention, it becomes possible to completely decompose the iron complex salt which forms in the zinc plating bath by use of conventional treatment techniques.

Accordingly, there has been a need in the industry for a cyanide-free zinc plating bath and process of the strong alkali type. Typical of the baths and processes developed to date is the alkali-zincate type bath containing sodium zincate and an excessive amount of sodium hydroxide. Unfortunately, when zinc plating is produced from this type of basic alkali-zincate bath, the zinc plating deposited on the substrate is lacking in brightness, smoothness of grain and adherence of the zinc coating. In order to improve the zinc plating provided by the conventional alkali-zincate system, attempts have been made to add brightening agents to the plating baths.

For example, it is known that suitable brighteners and additives for such an alkali-zincate zinc plating system are salts of gluconic acid, alkyl amines, and alkylene amines such as ethylenediamine, triethylenetetramine and tetraethylenepentamine. Furthermore, these brighteners and additives have been utilized alone or in combination with aromatic aldehydes. However, even with use of these conventional brightening agents, it is difficult to produce a uniform and homogeneous zinc plating on the substrate to be plated. For example, when aromatic aldehydes are utilized, care must be taken not to operate at higher temperatures, which would otherwise be desirable, since the aromatic aldehydes are not stable in alkali solution and their breakdown will be accelerated by the higher temperatures. Accordingly, since the operating and plating conditions utilizing the conventional types of brightening agents are limited, if good gloss, brightness and appearance are to be obtained, use of these conventional brightening agents alone are still insufficent to provide a practical plating bath and process for industrial purposes.

Recently, it has been found that water-soluble polyamine sulfone compounds can be utilized and are useful as a brightening agent for alkali-zincate type zinc plating systems.

For example, U.S. Pat. No. 4,030,987 of Fujita et al discloses a class of such polyamine sulfone compounds which when utilized together with an aromatic aldehyde in an alkali-zincate plating system provide improved brightness and have stability equal or superior to that obtained when plating from a zinc plating bath containing a cyanic compound. However, the combination of such polyamine sulfone compounds with an aromatic aldehyde restricts the operating conditions, particularly with regard to temperature, as a result of the aforementioned fact that aromatic aldehydes are unstable in an alkaline solution and will deteriorate more rapidly at higher temperatures. Thus, the additional desired benefits of operating such a cyanide-free plating system at higher temperatures cannot be readily obtained in accordance with the non-cyanide plating system disclosed by U.S. Pat. No. 4,030,987.

SUMMARY OF THE INVENTION

In accordance with the invention, it has been discovered that both bright and semi-bright zinc platings can be obtained by electroplating or electro-depositing from a novel, alkali-zincate type zinc plating bath and in accordance with a novel process which is free of cyanic compounds, which novel bath and process utilize the combination of a polyamine sulfone compound of the type disclosed in the aforementioned U.S. Pat. No. 4,030,987 and a quaternary pyridine compound, as brightening agents. The preferred quaternary pyridine compounds utilized in accordance with the present invention are N-benzyl-3-methyl carboxylate pyridinium chloride and nicotinic acid-N-oxide.

Furthermore, in accordance with the present invention a novel process is provided for obtaining bright and semi-bright zinc platings from a cyanide-free, alkali-zincate type zinc plating system whereby a polyamine sulfone compound is included in combination with a quaternized pyridine compound in an alkali-zincate type zinc plating bath which is then subjected to electro-deposition conditions.

Accordingly, it is an object of the present invention to provide a zinc plating process utilizing a cyanide-free plating bath containing a novel combination of brightening agents which is capable of providing uniformity in deposition of bright or semi-bright zinc plating having brightness and stability which are equal to or superior to those obtained by utilizing a conventional plating bath containing cyanic compounds. It is a further object of the present invention to provide an industrial process, free of detrimental effects on the environment or safety hazards to those working with said baths.

DESCRIPTION OF THE PREFERRED EMBODIMENTS

In accordance with the invention, an improved zinc plating process and novel bath free of cyanic compounds has been discovered and found to provide improved zinc plating films and operating conditions. In addition, the bath and process of the present invention are advantageously beneficial in that they do not require extensive facilities for treating waste solutions, as is required when using baths and processes containing cyanic compounds, and therefore causes no substantial pollution or other adverse effects on the environment.

In accordance with the first preferred embodiment of the invention, an improved zinc plating process is provided comprising addition of the combination of a water-soluble polyamine sulfone compound and a quaternary pyridine compound to an aqueous zinc plating bath of the alkali-zincate type and thereafter subjecting the resulting bath to electro-deposition conditions to effect plating of a zinc film on a ferrous metal substrate. The polyamine sulfone compounds utilized in accordance with the invention are those having the formula:

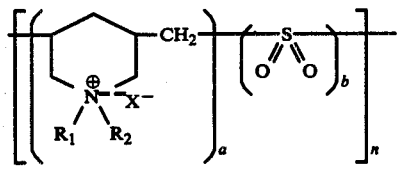

wherein each of $R_1$ and $R_2$ is a member selected from the group consisting of hydrogen, an allyl group, straight-chain and branched-chain alkyl groups each having 1 to 16 carbon atoms, an aralkyl group, and a hydroxyalkyl group of the general formula HO —$(CH_2)m$, where m is an integer between 1 to 6;

$X^-$ is a member selected from the group consisting of halogen ion, $HSO_4^-$, $HSO_3^-$, $HCOO^-$, and $CH_3COO^-$;

"n" is an integer such that the number average molecular weight becomes 2,000 to 350,000; and "a" and "b" are natural numbers having a relation such that $a:b$ = 100:(10 to 100).

The polyamine sulfone compounds which may be used in accordance with the invention are known and disclosed in Japanese Patent Publications Nos. 37033/1970 and 343/1970.

The degree of polymerization of these polyamine sulfones which are effective for use in the zinc plating method of the present invention, ranges between the average molecular weights of 2,000 to 350,000. If the average molecular weight is less than 2,000 difficulties may be encountered producing a suitable polymeric material. On the other hand, if the average number molecular weight exceeds 350,000 the zinc plating film is susceptible to becoming overly hard and will be difficult to work.

Furthermore, with an increase in "b", that is the molar number of the $SO_2$ Group, a zinc plating film having the desired degree of surface luster can be obtained. However, production of polyamine sulfone in excess of the ratio $a:b$ = 100:100 is difficult to achieve, so the maximum limit of "b" should be about 100 for "$a$" *32* 100. Furthermore, the quality of the zinc plating film is inferior when "b" is less then 10, where "$a$" = 100. Thus, the molecular number of $SO_2$ is important and, preferably, "b" should be about 40 or more for "$a$" = 100.

Accordingly, the quantity of polyamine sulfone utilized will differ with factors such as the specific composition of the alkaline zinc plating bath into which it is added, the specific type of polyamine sulfone within the purview of the invention which is utilized, and the characteristics of the required zinc plating film. Generally, however, where an alkaline zinc plating bath of sodium zincate and sodium hydroxide is used, the quantity added should be in the range of 1 to 10 grams/liter. While it is within the purview of the invention that this range of polyamine sulfone can be exceeded, it is economically impractical to do so and provides no further technical advantage or benefit. On the other hand, if the amount of polyamine sulfone added is too small, a suitable zinc plating film cannot be achieved.

While the polyamine sulfone compounds can be added to an aqueous zinc plating bath of the alkali-zincate type and provide a sufficiently glossy zinc deposit, it has been discovered that substantially improved gloss and brightness can be obtained by adding in combination therewith a quaternary pyridine compound which is compatible with the polyamine sulfone compound in the plating bath. The greater the amount of quaternary pyridine compound which is used in accordance with the invention, the better the gloss and brightness of the resulting zinc deposit.

Furthermore, in accordance with the invention, it has been discovered that the novel bath and process provide an improved zinc plating over that which can be obtained utilizing the method and baths indicated in the aforementioned U.S. Patent of Fujita et al wherein a polyamine sulfone compound is utilized, optionally, in combination with an aromatic aldehyde. In one regard, since the quaternary pyridine compounds of the present invention are more stable than the aromatic aldehydes in a strong alkali solution, such as exists in an alkali-zincate system, higher operating temperatures can be effectively utilized and the accompanying benefits of improved efficiency and quality of the resulting zinc plating can be obtained. Plating at temperatures in excess of 25° C, and preferably in excess of 30° C, provides greater efficiency both at the anode and cathode (i.e. providing a greater rate of zinc deposition), as well as a more conductive plating solution and a resulting plating which is more ductile. Other advantages which can be realized by use of quaternary pyridine compounds in accordance with the invention include improved economy and efficiency, improved solubility in the bath solution and greater stability for recovery purposes, as compared with aromatic aldehydes.

Nevertheless, it is within the purview of the invention that aromatic aldehydes can, optionally, be included in the process and bath of the invention, since they are not incompatible and cause no substantial detrimental effects. In some cases, their inclusion may offer marginal further improvement in brightening and gloss. However, in view of the aforementioned disadvantages inherent in the use of aromatic aldehydes, their inclusion in not recommended in the preferred embodiments of the invention.

The preferred quaternary pyridine compounds which may be used in accordance with the invention are N-benzyl-3-methylcarboxylate pyridinium chloride and nicotonic acid-N-oxide. However, the quaternary pyridine compounds which can be used in accordance with the process and bath of the invention are not restricted solely to these preferred quaternary pyridine compounds. Other such compounds are disclosed in U.S. Pat. No. 3,318,787 of Rindt et al and U.S. Pat. No. 3,411,996 of Rushmere.

The zinc plating baths which can be utilized in accordance with the invention are basically any aqueous, strong alkali bath containing zinc in a soluble state dispersed therein. Generally, such a zinc plating bath contains zinc oxide and sodium hydroxide, or caustic soda, in addition to water. In such a solution, the zinc is dispersed in the form of sodium zincate. However, the zinc plating baths used in accordance with the invention should be substantially, if not completely, free of cyanic compounds.

Conventional zinc bath additives may also be included in the bath and process of the invention for their known benefits and functions. For example, polyvinyl alcohol may optionally be included in the zinc plating bath, preferably within the range of 0.01 to 1.0 g/l.

In addition, if deionized or distilled water (which is preferred) is not used, either because it is not available in certain geographical areas or because it would be prohibitively expensive to provide the same, conventional additives such as sugar or ethylene diamine tetraacetic acid (EDTA) may be added to avoid streaking or other zinc plating deficiencies, caused by the hardness of the water. Other additives and conditioners which may be utilized include, but are not limited to, sodium carbonate, silicates, phosphates, gluconates and the like.

The electro-deposition conditions to which the zinc plating bath of the invention is subjected are generally the same conditions utilized when zinc plating is carried out in a conventional alkali plating bath containing cyanic compounds. For example, for testing purposes a standard HULL cell method may be utilized, with a current density ranging from approximately 0.5 to 25A/dm$^2$ to provide a zinc deposit having a high degree of brightness.

Although when plating with a zinc bath containing cyanic compounds or a cyanide-free alkali-zincate bath utilizing aromatic aldehyde the temperature of the bath should not exceed about 35° C, in accordance with the invention zinc plating may be carried out at higher temperatures. The polyamine sulfone compounds and the quaternary pyridine compounds used in accordance with the invention do not decompose in a plating bath even at temperatures in excess of 40° C. Therefore, the plating bath of the invention can be effectively used at temperatures in excess of 40° C. As a result, both greater efficiency and improved zinc plating can be obtained, without the necessity of utilizing plating apparatus having cooling means to keep the temperature below 35° C.

In order to illustrate more fully the process and baths of the invention, the following examples are set forth, it being understood that these examples are illustrative only and that they are not intended to limit the scope of the invention.

EXAMPLES

In accordance with preferred embodiments of the invention, an aqueous, alkali-zincate type plating bath is provided containing zinc metal in the range of about 0.75 - 40 g/l in the form of sodium zincate. Preferably, the zinc metal concentration will range between 3.0 - 15 g/l and more preferably between 7.5 - 13 g/l. Caustic soda in the form of sodium hydroxide is provided in a range of about 7.5 - 275 g/l, and water, preferably deionized or distilled, is added to volume.

To the foregoing alkali-zincate plating bath is then added a quaternized polyamine sulfone (in the form of a 25 wt. % aqueous solution) in an amount ranging from about 0.1 to 100 g/l and preferably from about 2.4 to 12 g/l. The quaternary pyridine compound is added to the alkali-zincate plating bath in an amount ranging from about 0.005 to 2.0 g/l.

Among conventional zinc plating additives which may be included in accordance with the invention are polyvinyl alcohol, preferably utilized in a range of about 0.01 to 1.0 g/l; sugar in a range of about 3.25 to 45 g/l; and EDTA in a range of about 0.25 to 25 g/l.

Therefore, in accordance with the invention, a novel, cyanide-free zinc plating bath of the alkali-zincate type may be comprised of the following constituents in the ranges of active ingredients indicated:

| | |
|---|---|
| Zinc Metal | 0.75 - 40 g/l |
| Caustic Soda (NaOH) | 7.5 - 275 g/l |
| Polyamine Sulfone (25 wt. % Aqueous Solution) | 0.1 - 100 g/l |
| Quaternary Pyridine Compound | 0.001 - 2.0 g/l |

EXAMPLE 1

A basic alkali-zincate type plating bath was prepared having the following composition:

| | |
|---|---|
| Zinc Oxide | 11.25 g/l |
| Sodium Hydroxide | 90 g/l |

To this basic plating bath was then added 4.8 g/l of a 25 wt. % aqueous solution of polyamine sulfone and 0.05 g/l of N-benzyl-3-methyl-carboxylate pyridinium chloride in aqueous solution. The polyamine sulfone utilized has the formula

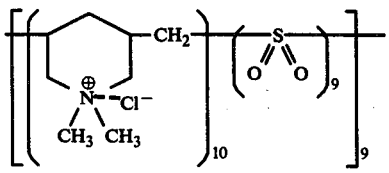

Deionized water was utilized in the various aqueous solutions and was added to volume. The plating bath was placed in a standard HULL cell and a steel plate plated at a bath temperature of 30° C, without agitation, at a total current of 2 amps for 5 minutes. At current density ranges from 0–20 A/dm$^2$, the resulting zinc deposit showed excellent brightness across the entire range of current density.

EXAMPLE 2

The plating bath described in Example 1 was prepared, however, 0.5 g/l of polyvinyl alcohol was added to the bath. Furthermore, tap water was utilized and 15 g/l of sugar was included in the bath. Again a steel plate was plated in a HULL cell at a bath temperature of 30° C with a total current of 2 amps for 5 minutes without agitation. The resulting zinc plate deposited on the steel plate showed excellent brightness across the entire range of current density.

EXAMPLE 3

A zinc plating bath was prepared as in Example 1, except that 0.1 g/l of nicotinic acid-N-oxide in aqueous solution was substituted in place of the N-benzyl-3-methyl-carboxylate pyridinium chloride. Electroplating of a steel plate was conducted in a standard HULL cell, in accordance with the conditions indicated in Example 1, with the resulting zinc plate likewise showing excellent brightness across the entire range of current density.

EXAMPLE 4

A zinc plating bath was prepared as in Example 1 and placed in a standard HULL cell. A steel plate was then plated in the HULL cell at a bath temperature of 40° C, without agitation, at a total current of 2 amps for 5 minutes. At current densities ranging from 0 – 20 A/dm$^2$, the resulting zinc deposit showed excellent brightness across the entire range of current density.

Although the above specific Examples are given solely for purposes of illustration, it will be understood that such baths and processes may be altered, varied and modified without departing from the spirit and scope of the invention as defined by the appended claims.

What is claimed is:

1. An improved zinc plating process which comprises adding a water-soluble, polyamine sulfone compound and a quaternary pyridine compound to an aqueous cyanide-free zinc plating bath of an alkali-zincate type and subjecting the resulting bath to electro-deposition conditions, said polyamine sulfone compounds having the formula

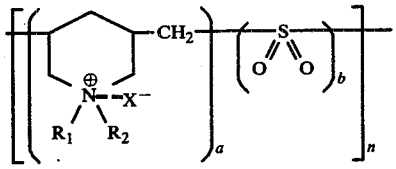

wherein each of $R_1$ and $R_2$ is a member selected from the group consisting of hydrogen, an allyl group, straight-chain and branched-chain alkyl groups each having 1 to 16 carbon atoms, an aralkyl group, and hydroxyalkyl groups of the general formula HO —$(CH_2)m$, where m is an integer of 1 to 6;

$X^-$ is a member selected from the group consisting of halogen ion, $HSO_4^-$, $HSO_3^-$, $HCOO^-$, and $CH_3COO^-$;

"n" is an integer such that the number average molecular weight becomes 2,000 to 350,000; and "a" and "b" are natural numbers having a relation such that $a{:}b$ = 100:(10 to 100).

2. The zinc plating process of claim 1 wherein said polyamine sulfone has the formula

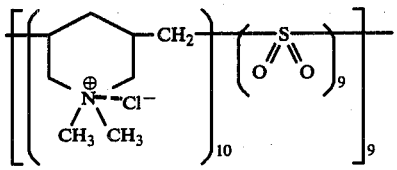

3. The zinc plating process of claim 1 wherein said quaternary pyridine compound is N-benzyl-3-methyl-carboxylate pyridinium chloride.

4. The zinc plating process of claim 1 wherein said quaternary pyridine compound is nicotinic acid-N-oxide.

5. The zinc plating process of claim 1 wherein the polyamine sulfone compound is added in a quantity of 0.1 to 100 g/l of a 25 wt. % aqueous solution.

6. The zinc plating process of claim 1 wherein the polyamine sulfone compound is added in a quantity of between 2.4 to 12 g/l of a 25 wt. % aqueous solution.

7. The zinc plating process of claim 1 wherein said quaternary compound is added in a quantity of between 0.001 to 2.0 g/l.

8. An aqueous, cyanide-free zinc electroplating bath of the alkali-zincate type comprising in ranges of active ingredients:

| | |
|---|---|
| Zinc Metal | 0.75 to 40 g/l |
| Caustic Soda (NaOH) | 7.5 to 275 g/l |
| Polyamine Sulfone (25 wt. % Aqueous Solution) | 0.1 to 100 g/l |
| Quaternary Pyridine Compound | 0.001 to 2.0 g/l, |

wherein said polyamine sulfone compound has the formula

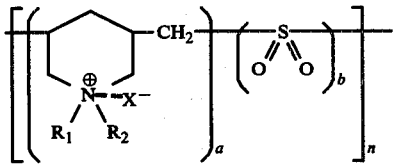

wherein each of $R_1$ and $R_2$ is a member selected from the group consisting of hydrogen, an allyl group, straight-chain and branched-chain alkyl groups each having 1 to 16 carbon atoms, an aralkyl group, and hydroxyalkyl groups of the general formula HO-(-$CH_2$)$m$, where m is an integer of 1 to 6;

$X^-$ is a member selected from the group consisting of halogen ion, $HSO_4^-$, $HSO_3^-$, $HCOO^-$, and $CH_3COO^-$;

"n" is an integer such that the number average molecular weight becomes 2,000 to 350,000; and "a" and "b" are natural numbers having a relation such that $a{:}b$ = 100:(10 to 100).

9. The aqueous, cyanide-free-free zinc electroplating bath of claim 8 wherein said zinc metal is provided in the form of zinc oxide, said caustic soda is sodium hydroxide and said quaternary pyridine compound is N-benzyl-3-methyl-carboxylate pyridinium chloride.

10. The aqueous, cyanide-free zinc electroplating bath of claim 9 wherein said polyamine sulfone has the formula

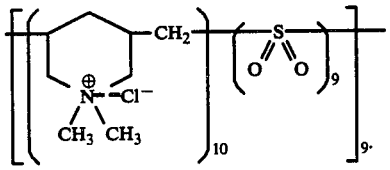

11. The aqueous, cyanide-free zinc electroplating bath of claim 9 wherein said quaternary pyridine compound is nicotinic acid-N-oxide.

12. The aqueous, cyanide-free zinc electroplating bath of claim 8 wherein said bath optionally contains polyvinyl alcohol in a range of about 0.01 to 1.0 g/l.

13. The aqueous, cyanide-free zinc electroplating bath of claim 8 wherein said polyamine sulfone is provided in a 25 wt. % aqueous solution in a range of 0.1 to 100 g/l.

14. The aqueous, cyanide-free zinc electropating bath of claim 8 wherein said bath optionally includes sugar in a range of about 3.25 to 45 g/l.

15. The aqueous, cyanide-free zinc electrolplating bath of claim 8 wherein said zinc metal is provided in the range of about 3.0 to 15 g/l.

16. The aqueous, cyanide-free zinc electroplating bath of claim 8 wherein said polyamine sulfone is provided in a 25 wt. % aqueous solution in a range of 2.4 to 12 g/l.

17. The aqueous, cyanide-free zinc electrolplating bath of claim 8 wherein said zinc metal is provided in a range of 7.5 to 13 g/l.

18. An aqueous, cyanide-free zinc electroplating bath comprising:

| | |
|---|---|
| Zinc Oxide | 11.25 g/l |
| Sodium Hydroxide | 90 g/l |
| Polyamine Sulfone | |

-continued

| | |
|---|---|
| (25 wt. % Aqueous Solution | 4.8 g/l |
| Quaternary Pyridine Compound | 0.05 g/l |
| Water | (add to adjust volume) |

wherein said polyamine sulfone has the formula

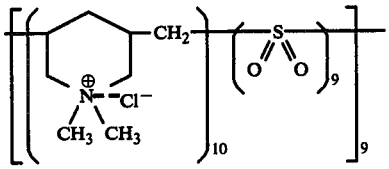

19. The aqueous, cyanide-free zinc electroplating bath of claim 18 wherein said quaternary pyridine compound is N-benzyl-3-methyl carboxylate pyridinium choloride in a 20 wt. % aqueous solution.

20. The aqueous, cyanide-free zinc electroplating bath of claim 18 which further includes 0.5 g/l of polyvinyl alcohol.

21. The aqueous, cyanide-free zinc electroplating bath of claim 18 wherein tap water is used and which further includes 15 g/l of sugar.

22. An aqueous, cyanide-free zinc electroplating bath comprising:

| | |
|---|---|
| Zinc Oxide | 11.25 g/l |
| Sodium Hydroxide | 90 g/l |
| Polyamine Sulfone | |
| (25 wt. % Aqueous Solution) | 4.8 g/l |
| Nicotinic Acid-N-Oxide | 0.1 g/l |
| Water | (Add to adjust volumn) |

wherein said polyamine sulfone has the formula

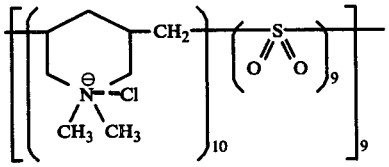

* * * * *

UNITED STATES PATENT AND TRADEMARK OFFICE

CERTIFICATE OF CORRECTION

PATENT NO. : 4,134,804

DATED : January 16, 1979

INVENTOR(S) : Joseph A. Zehnder et al

It is certified that error appears in the above-identified patent and that said Letters Patent are hereby corrected as shown below:

Column 4, line 14, "32" should read -- = --

Column 8, line 66, delete the second "free"

Column 9, line 37, "electrolplating" should read --electroplating--

Signed and Sealed this

*First* Day of *May 1979*

[SEAL]

*Attest:*

RUTH C. MASON
*Attesting Officer*

DONALD W. BANNER
*Commissioner of Patents and Trademarks*